US009010541B2

(12) United States Patent
Anderson

(10) Patent No.: US 9,010,541 B2
(45) Date of Patent: Apr. 21, 2015

(54) SHALE SHAKER SCREEN AND FASTENING SYSTEM

(75) Inventor: Michael Rai Anderson, Houston, TX (US)

(73) Assignee: Kem-Tron Technologies, LLC, Stafford, TX (US)

( * ) Notice: Subject to any disclaimer, the term of this patent is extended or adjusted under 35 U.S.C. 154(b) by 7 days.

(21) Appl. No.: 13/458,771

(22) Filed: Apr. 27, 2012

(65) Prior Publication Data

US 2013/0284646 A1 Oct. 31, 2013

(51) Int. Cl.
*B07B 1/49* (2006.01)
*B07B 1/28* (2006.01)

(52) U.S. Cl.
CPC ..... *B07B 1/28* (2013.01)

(58) Field of Classification Search
USPC ..... 209/405, 412
See application file for complete search history.

(56) References Cited

U.S. PATENT DOCUMENTS

| | | | | |
|---|---|---|---|---|
| 4,861,462 | A * | 8/1989 | Lehmann et al. | 209/269 |
| 5,950,841 | A * | 9/1999 | Knox et al. | 209/315 |
| 6,382,424 | B1 * | 5/2002 | Bolton et al. | 209/405 |
| 6,543,621 | B2 * | 4/2003 | Baltzer et al. | 209/405 |
| 7,810,649 | B2 * | 10/2010 | Robertson | 209/401 |
| 7,819,255 | B2 * | 10/2010 | Cady | 209/405 |
| 2003/0042179 | A1 * | 3/2003 | Adams et al. | 209/408 |
| 2004/0245154 | A1 * | 12/2004 | Baltzer et al. | 209/405 |
| 2005/0103689 | A1 * | 5/2005 | Schulte et al. | 209/405 |
| 2007/0125687 | A1 * | 6/2007 | Kutryk | 209/397 |

* cited by examiner

*Primary Examiner* — Ernesto Suarez
(74) *Attorney, Agent, or Firm* — Fredrikson & Byron, P.A.

(57) ABSTRACT

A shaker screen comprises a frame that has a plurality of opposing sides. The shaker screen also comprises a screen assembly attached to the frame. In addition, each side of the shaker screen comprises a tubular member having an inner edge, an outer edge, and defining a central axis. Further, a horizontal plane intersects the central axis, the outer edge, and the inner edge of each side.

14 Claims, 14 Drawing Sheets

SHALE SHAKER SCREEN AND FASTENING SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Disclosure

The present disclosure relates generally to the shale shaker screens used to filter solids out of drilling mud.

2. Description of Related Art

When drilling a well (e.g., for oil or gas), a drill bit is attached to the end of a drill string and drills a hole through the subsurface to access the oil or gas reservoir. Drilling fluid is used during drilling operations. Drilling fluid comprises, for example, a finely ground clay base material to which various chemicals and water are added to form a viscous fluid designed to meet specific physical properties appropriate for the subsurface conditions anticipated. This drilling fluid is pumped down the hollow drill pipe, through the drill bit and returned to the surface in the annular space between the drill pipe and the well bore.

The drilling fluid serves three main purposes. First, it aids in cooling the drill bit and thereby increasing its useful life. Second, the mud flushes the cuttings or "solids" from the well bore and returns them to the surface for processing by a solid control system. Third, the mud leaves a thin layer of the finely ground clay base material along the well bore walls which helps prevent caving in of the well bore wall.

Although often referred to simply as "mud," the drilling fluid is a complex composition which must be carefully engineered and tailored to each individual well and drilling operation. The drilling fluid is costly and, thus, is cleaned and reused in a closed loop system in which a solids control system and a shaker play important roles.

A shaker, often referred to as a "shale shaker," is part of a solids control system used in oil and gas drilling operations to separate the solid material ("solids"), removed from the well bore by the drilling operation, from the drilling mud. For the drilling fluid to be used and reused, it must be processed after returning from the well bore to remove the aforementioned solids and maintain its proper density, often expressed as pounds per gallon or "mud weight", i.e., 10 lb./gal. mud or "10 lb. mud". The first step in processing the returned drilling fluid is to pass it through a shaker. The returned drilling fluid from the flow line flows into a possum belly, a container mounted at one end of the shaker, and then flows over one or more screens. A shaker includes a support frame on which the shaker screen is mounted. One or more motors in the shaker causes the screen assemblies to vibrate or oscillate, depending on the type of motors utilized. The vibrating action of the screens over which the mud passes removes larger particle size solids (e.g., in the 200 to 700 micron size range) while allowing the drilling fluid and smaller particle size solids to pass through the screen. Solids, which are discarded from the top of the shaker screen, discharge into a pit or onto a conveyor for further treatment or disposal and the underflow drilling fluid flows into the tank below.

A common means to secure the screen in the shaker is through the use of a wedge block. A wedge block is typically inserted between the screen and a bracket located along the inside walls of the shaker. The wedge block is pushed further back under or into the bracket, in turn pushing the wedge downward onto the screen and onto the shaker. Two wedges are typically used per screen, but other combinations of wedges may be utilized.

A common means to seal the screen in the shaker is through the use of gaskets secured to the shaker at the screen interface. The gasket is typically secured to the shaker with various fasteners that wear out due to contact with the drilling fluid and solids. Thus, maintenance is required to replace worn gaskets and/or fasteners. Replacing the gaskets is time- and labor-intensive—the shaker must be taken offline, the wedge blocks removed, the screens removed, the fasteners ground off, the old gasket material removed, and the new gaskets installed with new fasteners, and then the screens and wedge blocks reinstalled.

Accordingly, there remains a need in the art for a shaker screen and sealing gasket capable of easy and efficient replacement, while retaining the necessary securing and sealing properties within a shaker device.

SUMMARY OF THE PRESENT DISCLOSURE

The embodiments described herein are generally directed to a means for securing and sealing a shaker screen in a shaker device.

In an embodiment, an assembly for securing and sealing a shaker screen in a shaker device comprises a shaker screen with tapered side members on which an elastomeric or pliable gasket is adhered. The assembly also comprises a support frame with angular channels that sealingly mate with the gaskets on the side members of the screens. The assembly further comprises a central, angular, bar anchor affixed to the shaker in between each group (upper and lower) of two shaker screens; the central, angular, bar anchor comprises an angular channel on each side, each of which retains a side member of a shaker screen. In addition, the assembly comprises a wedge block retention bracket affixed to the shaker side walls above each shaker screen. Moreover, the wedge block is insertable between the wedge block retention brackets and the shaker screens, providing forces both down onto the screen side member and laterally onto the tapered screen side member, which further presses the screen side member with a gasket into the angular channel of the central, angular, bar anchor, creating a seal.

Thus, embodiments described herein comprise a combination of features and advantages intended to address various shortcomings associated with certain prior devices. The various characteristics described above, as well as other features, will be readily apparent to those skilled in the art upon reading the following detailed description of the preferred embodiments, and by referring to the accompanying drawings. It should be appreciated by those skilled in the art that the conception and the specific embodiments disclosed may be readily utilized as a basis for modifying or designing other structures for carrying out the same purposes of the embodiments described herein. It should also be realized by those skilled in the art that such equivalent constructions do not depart from the spirit and scope of the invention as set forth in the appended claims.

BRIEF DESCRIPTION OF THE DRAWINGS

For a more detailed understanding of the preferred embodiments, reference is made to the accompanying Figures, wherein.

NOTATION AND NOMENCLATURE

Figure 1:
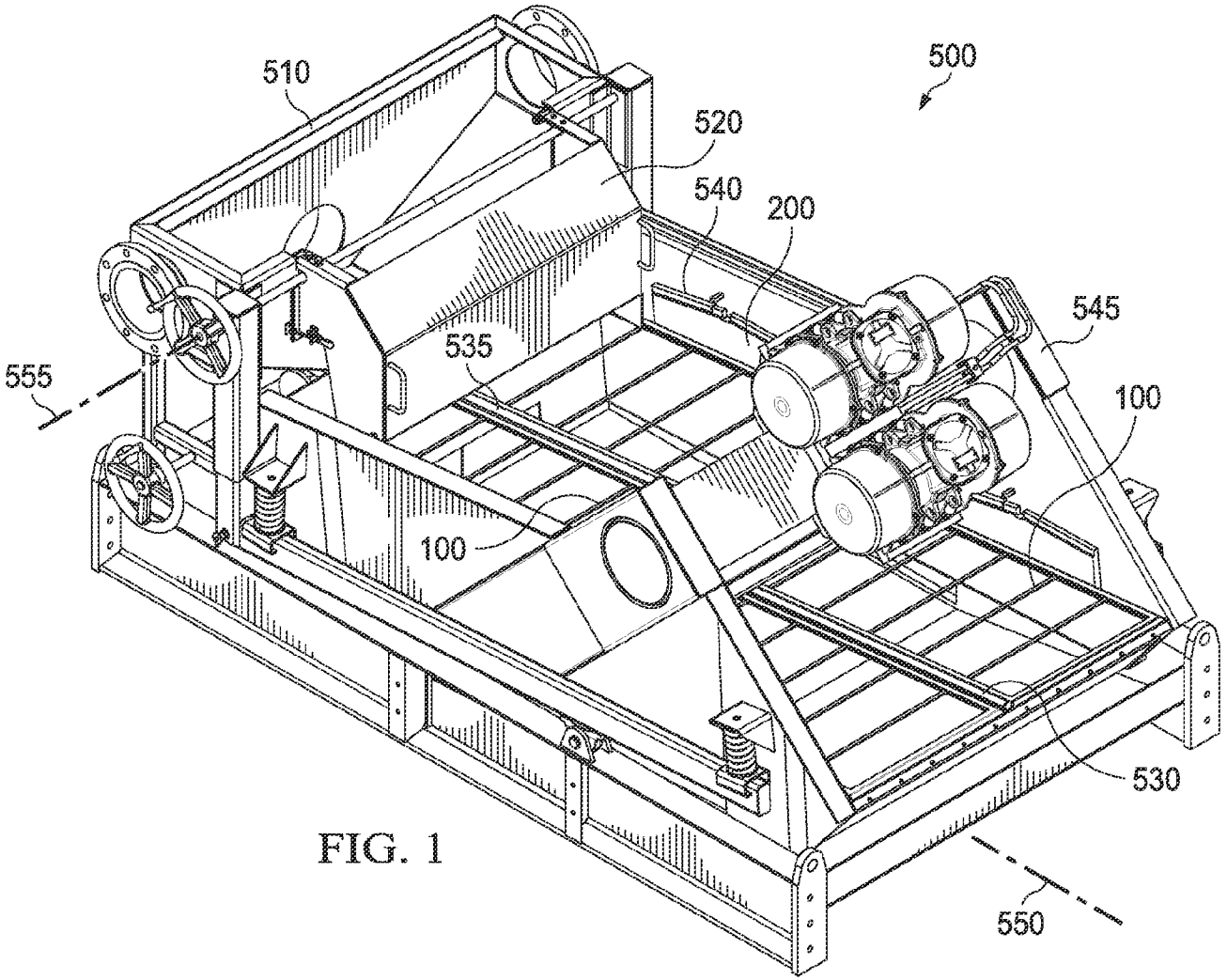
FIG. 1 is a perspective view of an embodiment of a shaker made in accordance with the principles described herein.

Certain terms are used throughout the following description and claim to refer to particular system components. This document does not intend to distinguish between components that differ in name but not function. Moreover, the drawing figures are not necessarily to scale. Certain features of the invention may be shown exaggerated in scale or in somewhat schematic form, and some details of conventional elements may not be shown in the interest of clarity and conciseness.

In the following discussion and in the claims, the term "comprises" and "comprising" are used in an open-ended fashion, and thus should be interpreted to mean "including, but not limited to . . . ." also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

FIG. 1 depicts a shaker 500 in accordance with various embodiments. In the example of FIG. 1, a plurality (e.g. 4) of shaker screens 100 is secured to the shaker 500 using both a central, angular, bar anchor 530 (anchor) and a wedge block 200 with a wedge block retention bracket 540. In other embodiments, only a single screen may be used. Though all four screens 100 and both anchors 530, 535 are visible, only one of the four wedge block retention brackets 540 and one of the four wedge blocks 200 are visible in the perspective view of FIG. 1. It should be appreciated that there are four wedge block retention brackets 540, each with a wedge block 200, in the illustrative shaker 500 shown in FIG. 1. The shaker 500 also comprises a gumbo tray 520 and a possum belly 510.

Figure 2A:
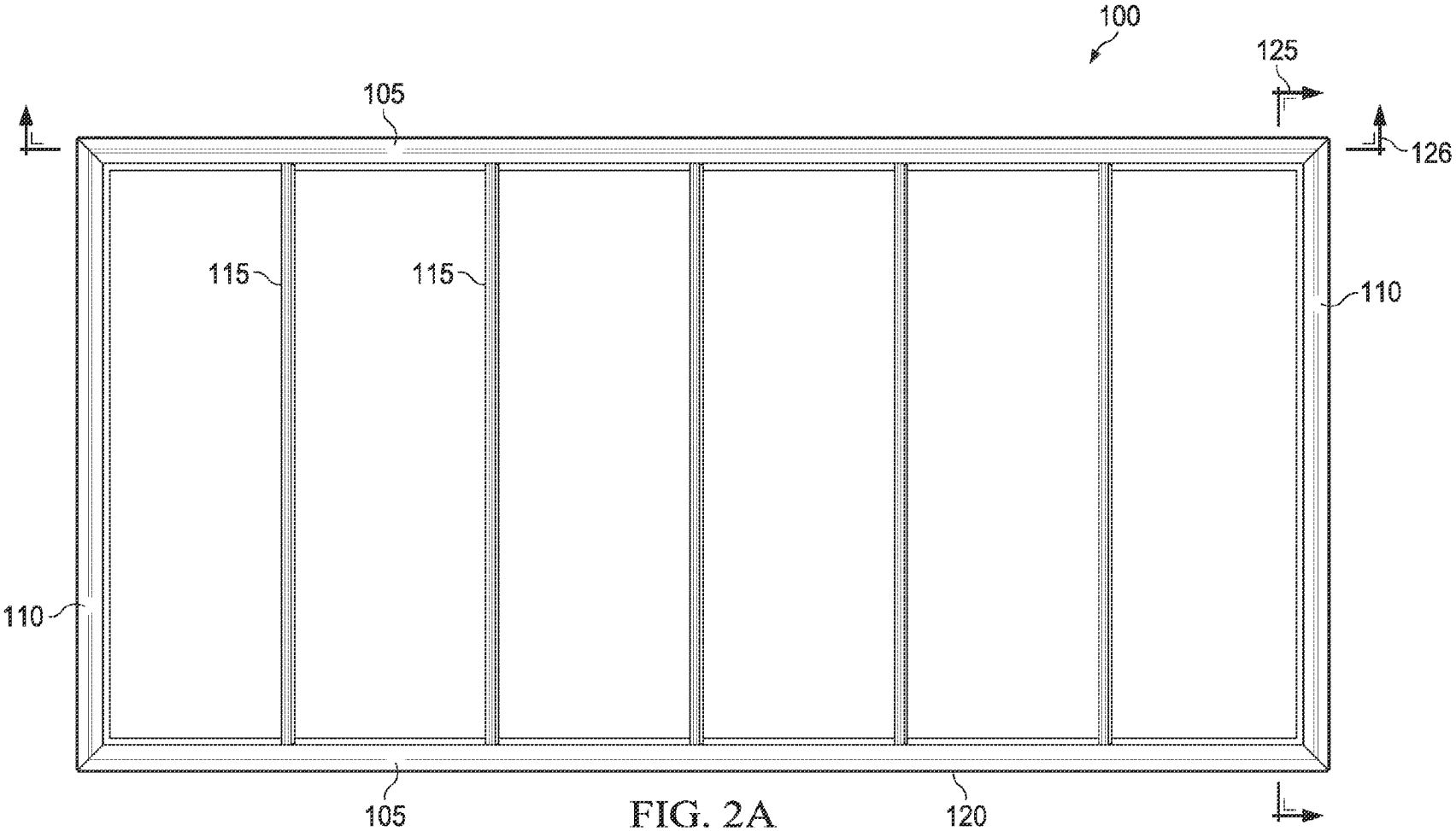
FIG. 2A is a top view of an embodiment of a shaker screen made in accordance with the principles described herein.

FIG. 2A illustrates a top view of a shaker screen frame 100. In a preferred embodiment, the screen frame 100 comprises side members 105, 110 and a plurality of cross members 115 that extend between and are secured to side members 105. The screen frame can further comprise a plurality of mesh screens (not shown) disposed on the cross members 115. The type and size of mesh screen (not shown) installed on the screen frame 100 can vary and does not affect the principles relied on herein; thus, shaker screen frame 100 will hereinafter be referred to simply as shaker screen 100 or screen 100. The cross members 115 preferably comprise square tubular members typically with smaller dimensions than the side members 105, 110. The side members 105, 110 are comprised of tubular members that are tapered at the sides (as will be discussed below in greater detail). Welds may be used to secure each end of side members 105 to each end of side members 110; welds also secure each end of the cross members 115 to the side members 105. The tapered configuration of the side members 105, 110 eliminates shearing weld stress on the screen 100 during shaker 500 operation. In other embodiments (not specifically illustrated) the quantity of cross members 115 may be increased or decreased from that shown in FIG. 2A.

Figure 2B:
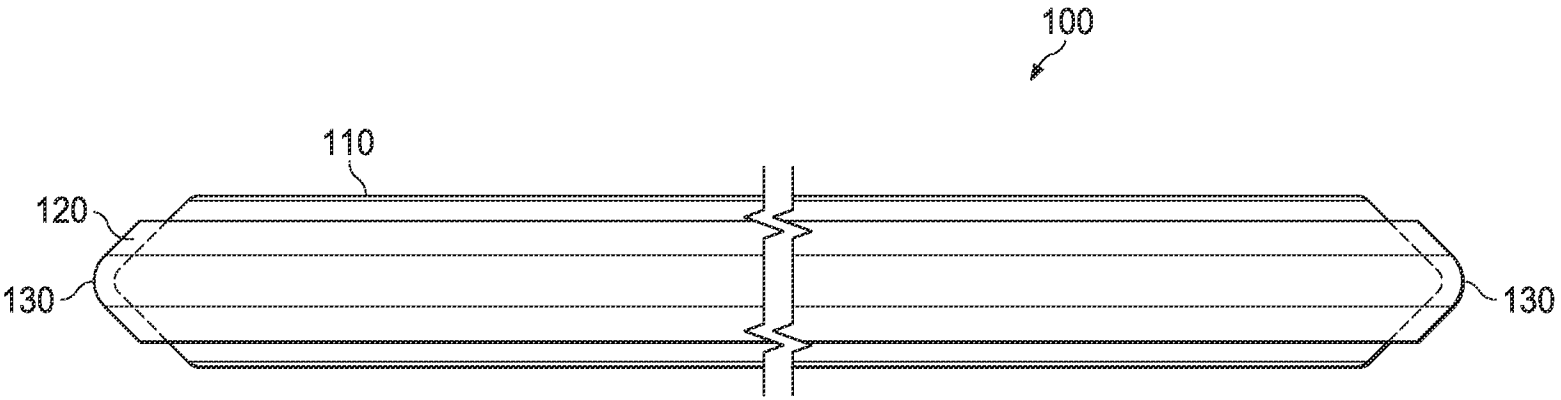
FIG. 2B is a side view of the screen shown in FIG. 2A.
Figure 2C:
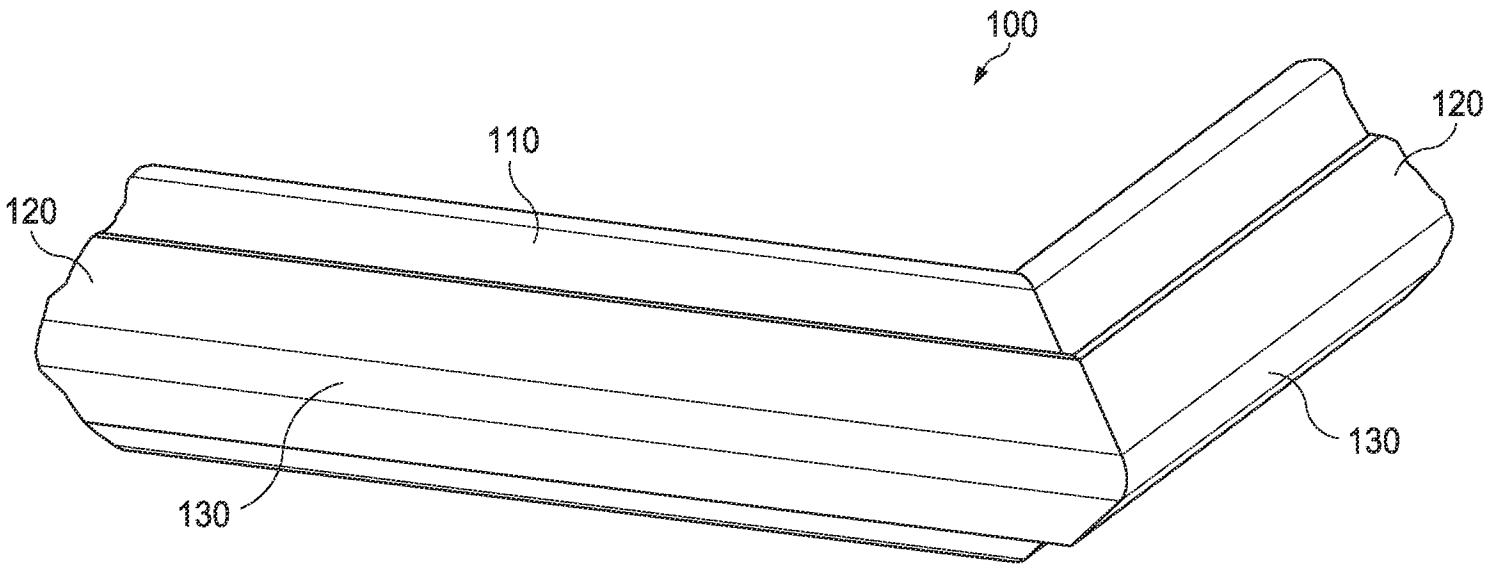
FIG. 2C is a perspective view of a portion of the screen shown in FIG. 2B.

Referring now to FIGS. 2B and 2C, FIG. 2B illustrates a side view of the screen 100 shown in FIG. 2A and FIG. 2C depicts a perspective view of a portion of the screen 100 shown in FIG. 2B. In an embodiment, the screen 100 further comprises an elastomeric gasket 120 that surrounds the outermost edge 130 of all exterior sides (indicated by dashed lines in FIG. 2B) of the screen 100 and a portion of the side members 105, 110. The gasket 120 can be of varying thicknesses and widths and can cover equal or non-equal portions above and below the outermost edge 130 of side members 105, 110. For example, the seal may be ½" wide with a total thickness of 1/16" and cover ¼" above and below the outermost edge 130. For ease of illustration of the screen 100 geometry, the gasket 120 is only depicted in FIGS. 2B and 2C; however, the gasket 120 can be assumed to be present but not shown in the remaining illustrated embodiments of the present disclosure.

Figure 3A:
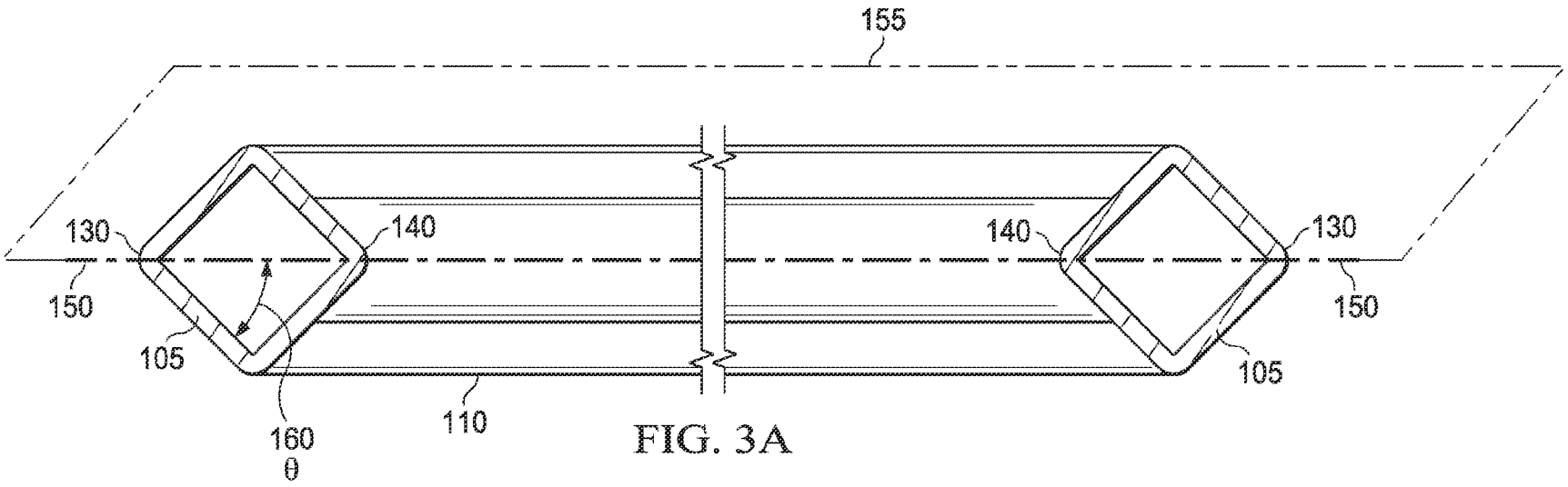
FIG. 3A shows a lateral cross-sectional view of the screen shown in FIG. 2A.
Figure 3B:
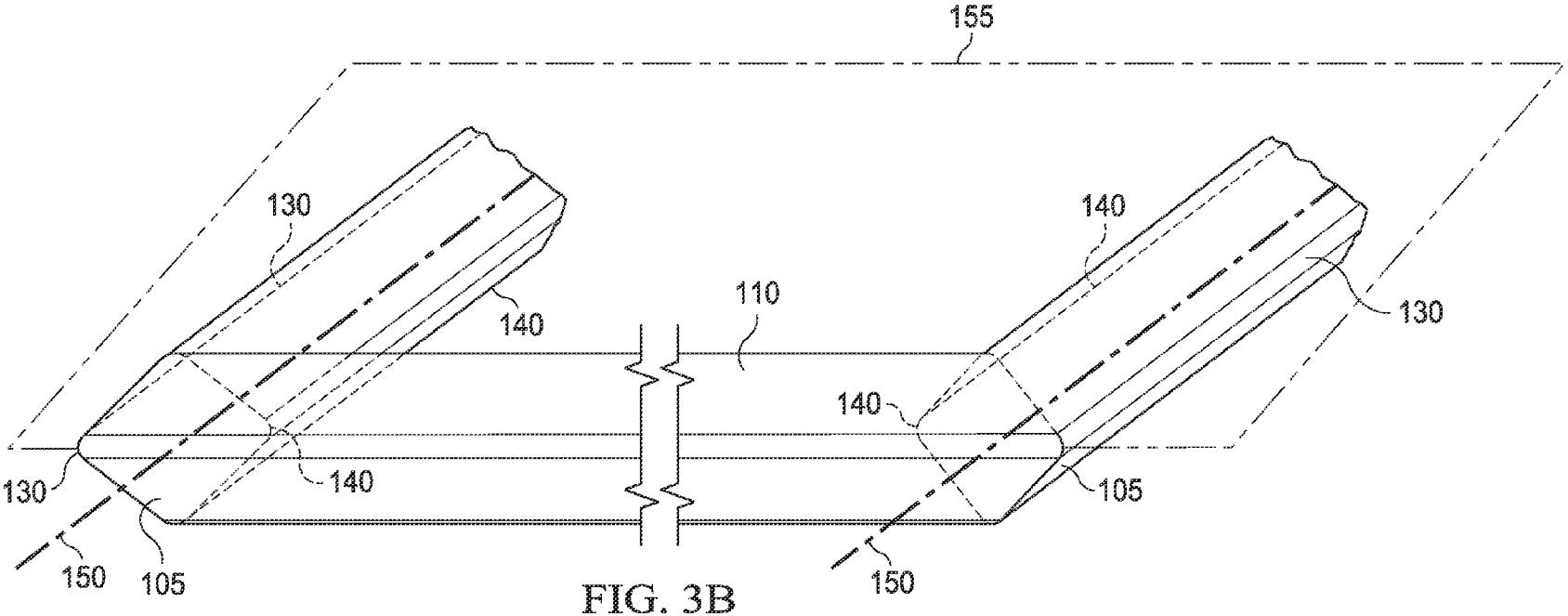
FIG. 3B illustrates a perspective view of the screen shown in FIG. 3A.

As previously discussed, the side members 105, 110 are comprised of tubular members that are tapered at the sides, rather than square as with conventional screens. Tapered sides provide the screen 100 described herein with various benefits as explained below. The geometry of the tapered side members 105, 110 can be more easily understood when viewing the side members 105, 110 in cross section. FIG. 3A illustrates a lateral cross-sectional view along line 125 of FIG. 2A and FIG. 3B depicts a perspective view of same. Each side member 105 further comprises a tubular member having an inner edge 140 and outer edge 130, a central axis 150 that runs longitudinally through the center of side member 105 and a horizontal plane 155, which intersects the central axis 150, the inner edge 140, and the outer edge 130 of each side member 105. Thus, in the cross sectional view, the side members 105 appear tapered at the outermost edge 130 and innermost edge 140. The taper angle 160 is measured from the horizontal plane 155 to an outer planar surface of side member 105 such that the apex is outer edge 130. It can be appreciated that a similar cross section 126, depicted in FIG. 2A, of side members 110 would yield a substantially similar cross-sectional view as that of cross section 125. Though not shown, the elastomeric gasket 120 would surround the outermost edge 130 of all side members 105, 110.

Figure 4B:
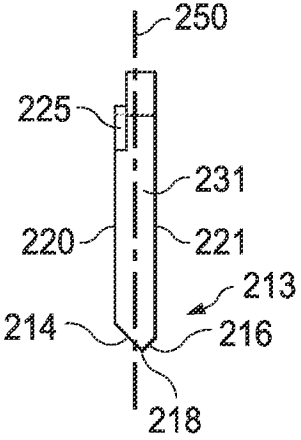
FIG. 4B is a side view of the wedge block shown in FIG. 4A.
Figure 4A:
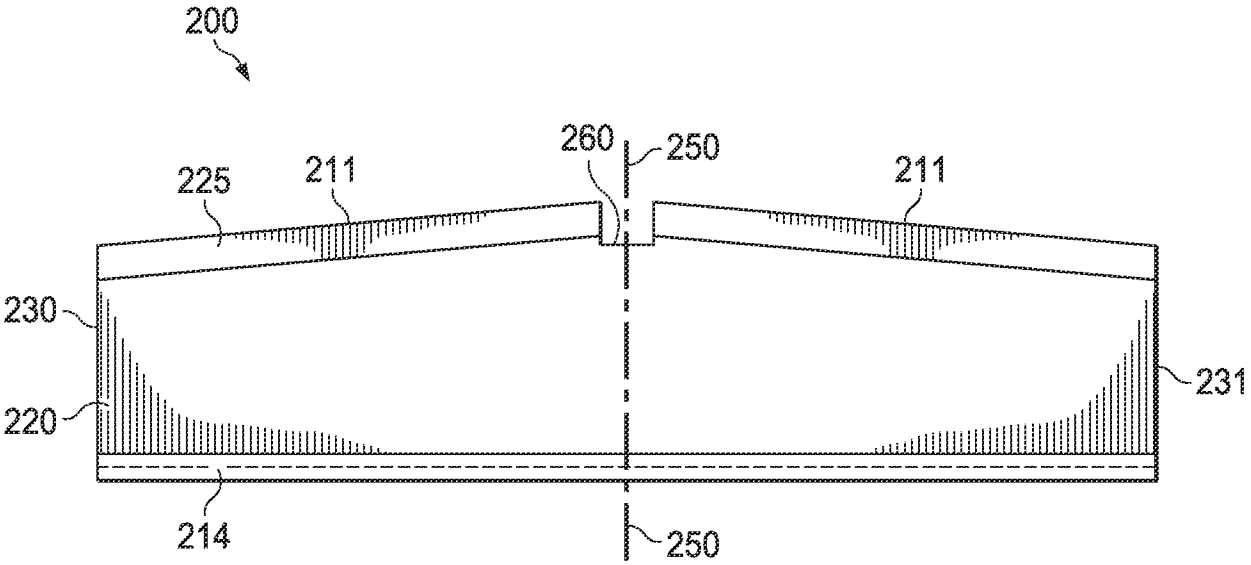
FIG. 4A is a view of the front face of an embodiment of a wedge block made in accordance with the principles described herein.

As shown in FIGS. 4A and 4B, wedge block 200 comprises a front face 220, back face 221, top end 211, bottom end 213, first side 230, second side 231, and a central axis 250 that runs longitudinally through and halfway between the first side 230 and second side 231 and halfway between the front face 220 and back face 221. Wedge block 200 also includes a bottom end 213 made up of two planar surfaces 214, 216, which are tapered and intersect to form bottom edge 218—bottom edge 218 is off center from the central axis 250 such that the bottom edge 218 is located closer to the back face 221 than to the front face 220 as can more easily be seen in FIG. 4B. Wedge block 200 is also provided with a top end 211 that is tapered from the first side 230 and second side 231 toward the central axis 250.

In an embodiment, the wedge block 200 further comprises a plurality of notches or cutouts including a notch 260 in the top end 211 such that the center of the cut out 260 aligns with the central axis 250 and the notch 260 extends from the front face 220 through the back face 221. In different embodiments (not specifically illustrated), the cut out 260 at the top end 211 may be off center from the central axis 250. In an embodiment, the wedge block comprises a notch 225 disposed on both the front face 220 and on the top end 211, extending from the first side 230 through the second side 231. Notch 225 also follows the same tapered configuration as the top end 211, which is tapered from the first side 230 and second side 231 toward the central axis 250. In the embodiment shown, each wedge block 200 is symmetrical along the central axis 250, thus, allowing one wedge block 200 to be used with any screen 100, regardless of the screen's location.

Figure 5A:
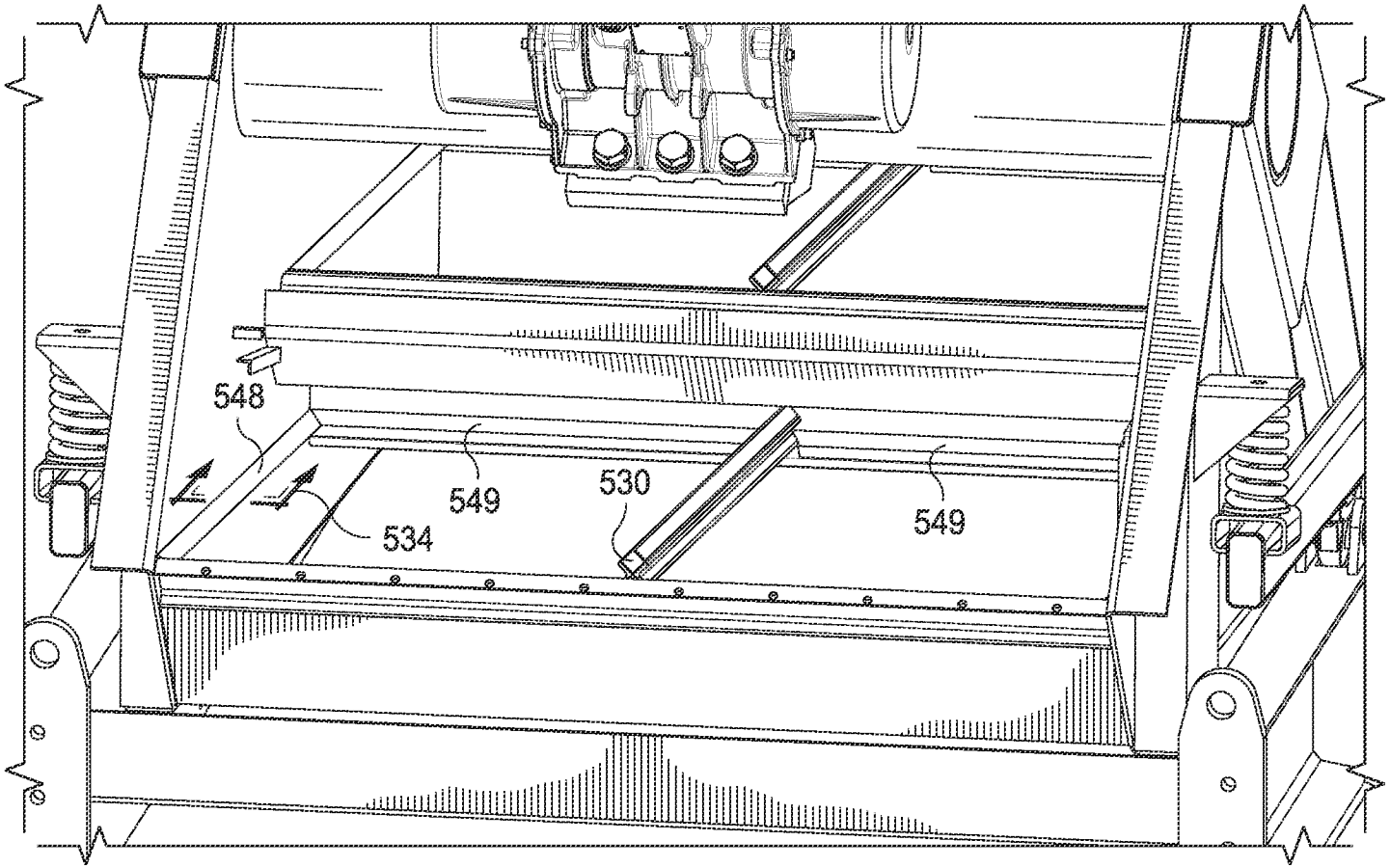
FIG. 5A is a perspective view of an embodiment of a shaker support frame in accordance with the principles described herein.
Figure 5B:
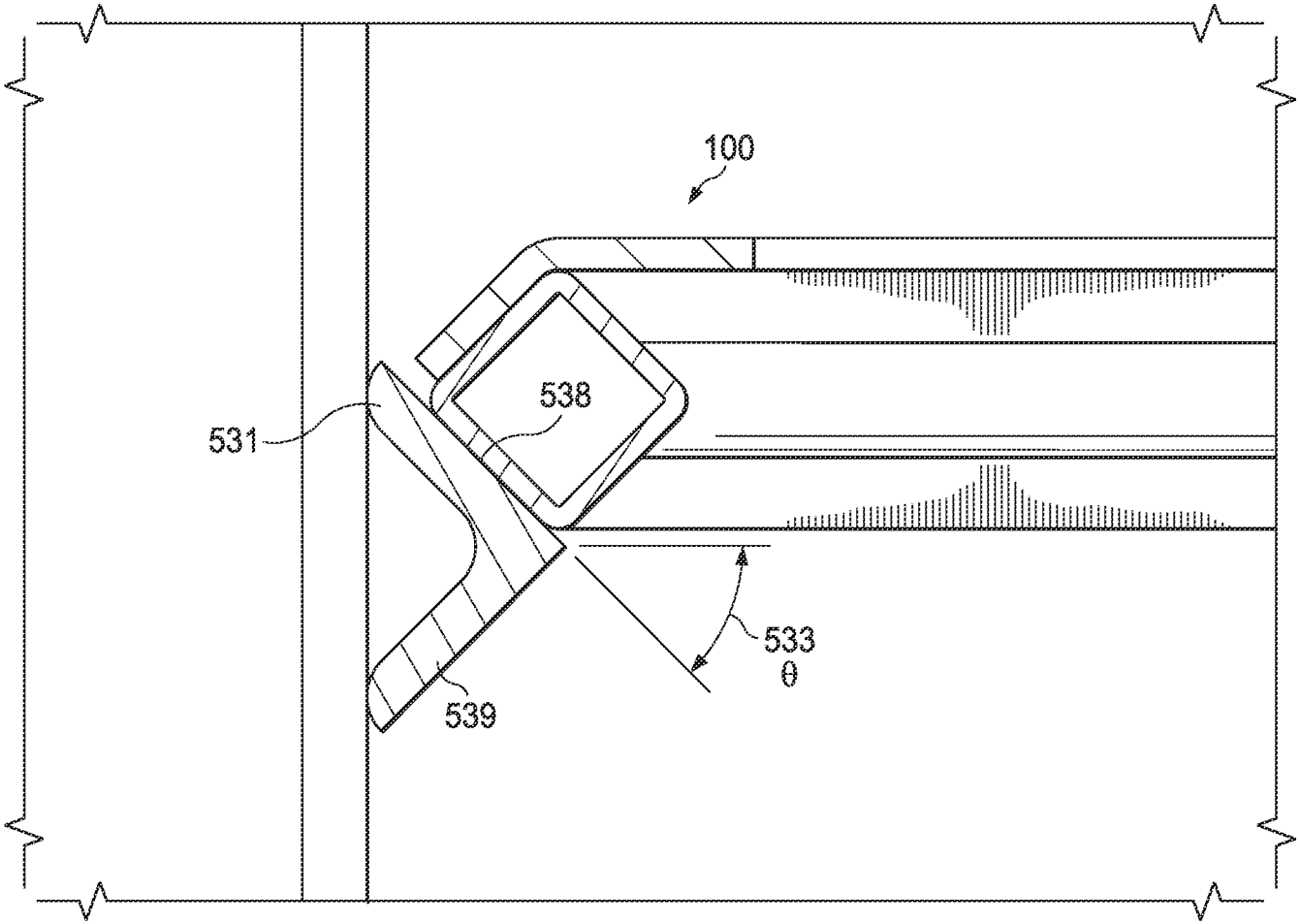
FIG. 5B shows a lateral cross-sectional view of a portion of the support frame shown in FIG. 5A.

Referring to FIG. 5A, an interface between screens 100 and the shaker 500 comprises a support frame 525. The support frame 525 includes a plurality of angled support members 548, 549 that sealingly contact the gasket 120 on side members 105, 110 of the screen 100. Referring now to FIG. 5B, which illustrates a lateral cross-sectional view of a portion of the support frame 525 along line 534 shown in FIG. 5A; a partial outline of a side member 105 of screen 100 (without gasket material) is shown in a substantially installed position merely to provide context. In an embodiment, angle 533 is measured from the top surface 538 to the base 539 of support member 548. The angle 533 of the support frame members 548, 549 is substantially the same as the taper angle 160 of side members 105, 110 as shown in FIG. 3A. In some embodiments, the angle 533 of the support frame members 548, 549 may be 45 degrees, but can be a different angle in other embodiments. For example, the angle 533 of the support frame members 548, 549 may be less than 45 degrees. In other implementations, the angle 533 of the support frame members 548, 549 is greater than 45 degrees.

Figure 6A:
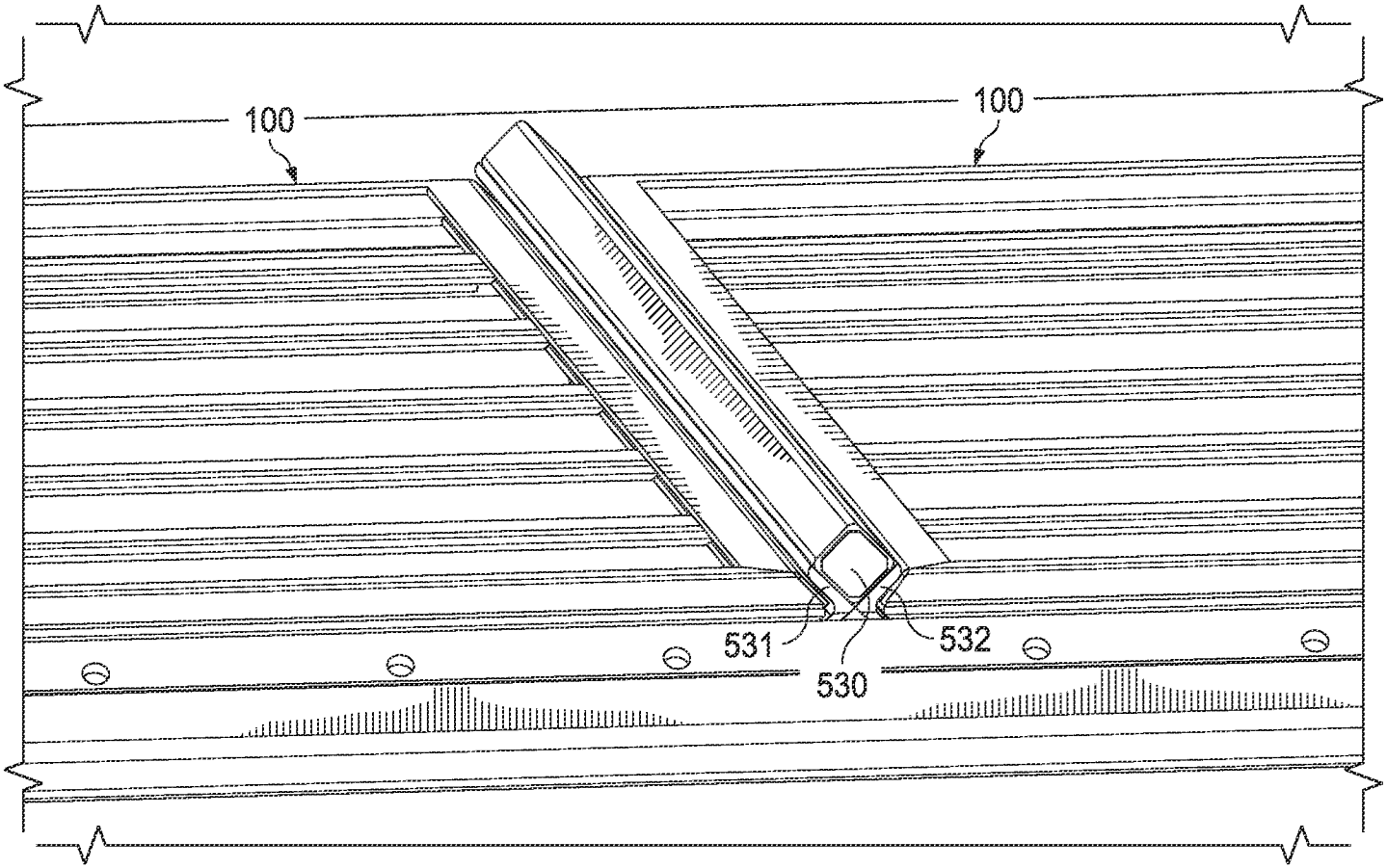
FIG. 6A is a perspective view of an embodiment of a central, angular, bar anchor in a shaker in accordance with the principles described herein.

The screen 100 and wedge block 200 interface with various components of the shaker device 500, which will be discussed herein in more detail. Referring back to FIG. 1, a shaker interface with screens 100 comprises a plurality of central, angular, bar anchors 530, 535 (anchor)—a lower anchor 530 and an upper anchor 535. Anchors 530, 535 are disposed axial to the central axis 550 and substantially in the center of shaker 500 such that a screen 100 may fit between the anchor and each side wall 545 of the shaker 500. Referring to FIG. 6A, anchor 530 further comprises angular channels 531, 532 that are diametrically opposed to one another. In an embodiment, each angular channel 531, 532 sealingly retains one side member 105 of each screen 100. Though only the lower anchor 530 is visible in FIG. 6A, it should be appreciated that the upper anchor 535, shown in FIG. 1, comprises angular channels 536, 537 and operates in substantially the same way as lower anchor 530.

Referring back to FIGS. 1 and 4C, a shaker interface with screens 100 comprises a plurality of wedge block retention brackets 540, each configured to retain a wedge block 200 against a screen 100. Each wedge block retention bracket 540 comprises an elongated substantially "L" shaped member disposed radially from the central axis 550 and attachably connected to the shaker side wall 545 above each shaker screen 100. A wedge block 200 is insertable between the wedge block retention brackets 540 and the shaker screens 100 such that the back face 221 of the wedge block is flush against the shaker wall 545 and the bottom end 213 interfaces with the screen side member 105. Though only one of the four wedge block retention brackets 540 and one of the four wedge blocks 200 are visible in the perspective view of FIG. 1, it should be appreciated that there are four wedge block retention brackets 540, each with a wedge block 200, disposed radially from the central axis 550 on the shaker side wall 545 above each shaker screen 100. Conventional shakers typically require the use of two wedge blocks per screen; the present disclosure uses half as many wedge blocks; thus, greatly reducing installation time.

Figure 4C:
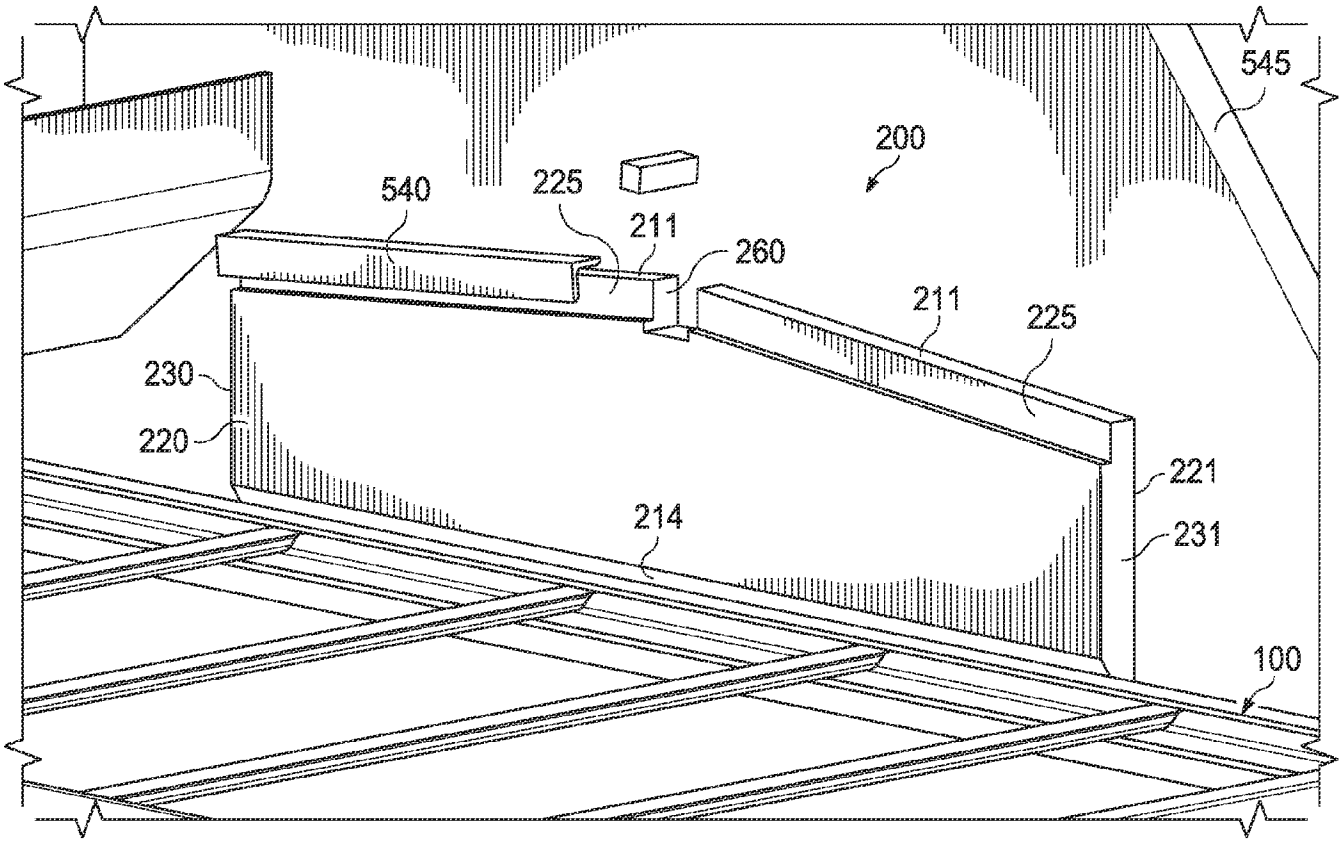
FIG. 4C is a perspective view of an embodiment of a wedge block installed in a shaker in accordance with the principles described herein.

Further, in an embodiment, each wedge block 200 is symmetrical along the central axis 250 (see FIG. 4A), thus, allowing one wedge block 200 configuration to be used with any screen 100—the wedge block 200 is simply oriented such that the back face 221 of the wedge block 200 is always flush against the shaker wall 545 while the top end 211 interfaces with the wedge block retention bracket 540 (see FIGS. 4A and 4C). Thus, in some embodiments, first side 230 will be inserted under a wedge block retention bracket 540 and in other embodiments, second side 231 will be inserted under a wedge block retention bracket 540.

Figure 6B:
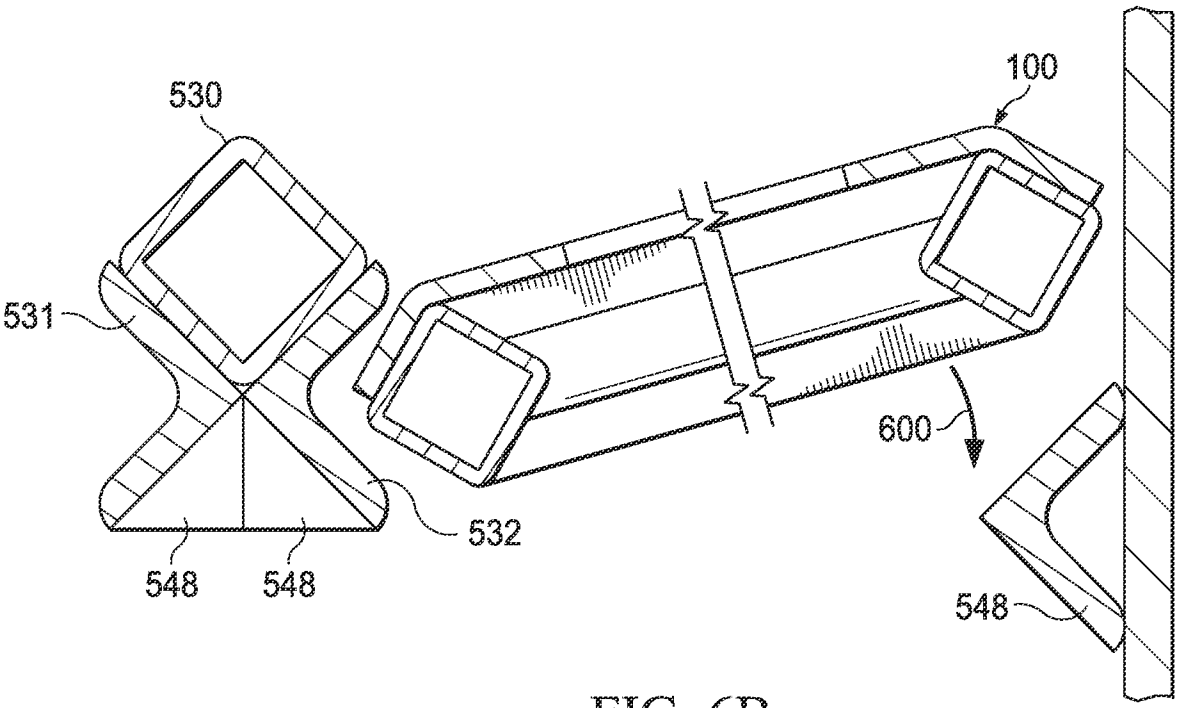
FIG. 6B is a partial schematic view showing an embodiment of a screen being installed in a shaker in accordance with the principles described herein.
Figure 6C:
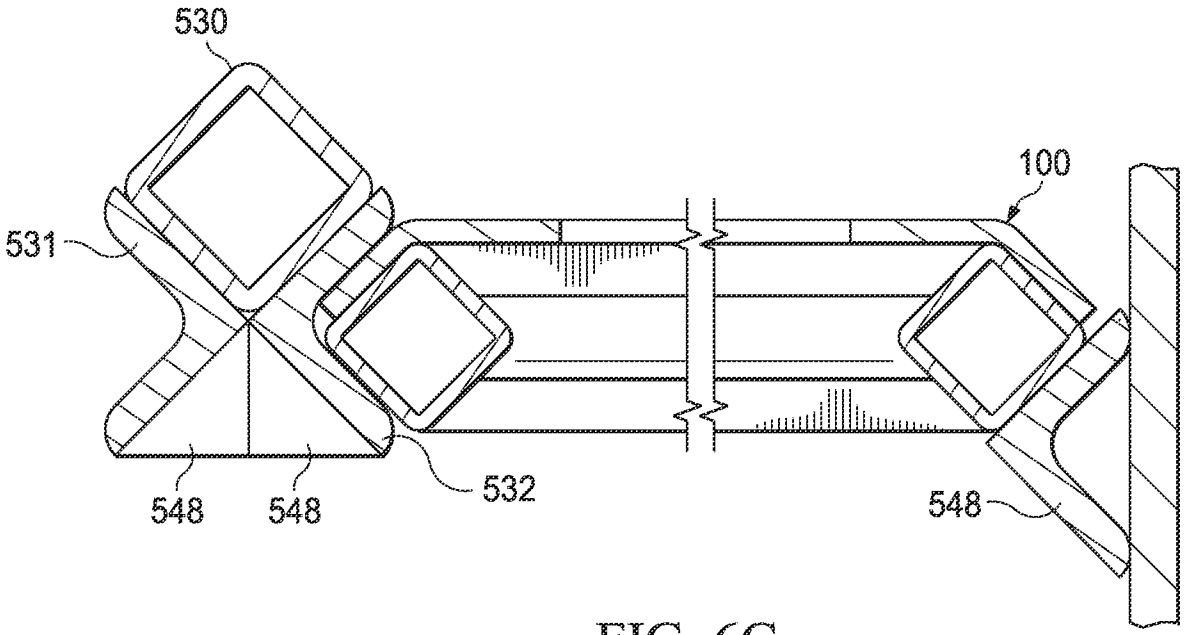
FIG. 6C is a partial schematic view showing an embodiment of a screen installed in a shaker in accordance with the principles described herein.

Referring to FIG. 1, before a shaker 500 can be used to remove solids from waste drilling fluids, shaker screens 100 must be installed in shaker 500. Referring now to FIG. 6A, in an embodiment, a screen 100 is installed into the shaker 500, by first placing a side member 105 into an angular channel 531, 532, 536, 537 of an anchor 530, 535. The mesh layers (not shown) should be facing upward when the screen 100 is installed in shaker 500. Once the side member 105 is placed in angular channel 531, 532, 536, 537 (see FIG. 6B), the screen is essentially self-seating—the screen 100 pivots along angular channel 531, 532, 536, 537 and can be released to drop in place (the motion of the screen 10 generally follows arrow 600) because the angles 533 of the support frame angular members 548, 549 form an inverted pyramidal shape (i.e. a funnel) configured to align with the taper angle 160 of the screen side members 105, 110. Once a screen 100 is seated in the support frame (see FIGS. 6C and 4C), a wedge block 200 is inserted between the wedge block retention bracket 540 and the shaker screen 100 such that the back face 221 of the wedge block is flush against the shaker wall 545. A hammer or other suitable tool is then used to pound the wedge block further under the wedge block retention bracket 540.

As previously described, certain embodiments disclosed herein comprise a gasket 120 fitted on the outer edge 130 of the screen 100 (see FIG. 2B). The application of a gasket 120 on the screen 100 itself removes the need to install gasket material on the support frame of the shaker 500 with the use of bolts or screws. Further, whenever a screen 100 is replaced due to normal wear and tear of the mesh layers (not shown), a new gasket 120 is automatically installed. Thus, replacing gasket material no longer requires the grinding of bolts and screws, reducing down time of the shaker 500.

As previously described, in an embodiment, the bottom edge 218 of the wedge block 200 is tapered (see FIG. 4B), which provides a force both downward onto the screen side member 105, but also laterally onto the tapered screen side member 105. This lateral force further presses the side member 105 with an elastomeric gasket 120 into the angular channel 531, 532, 536, 537 of the central, angular, bar anchor 530, 535, forming a substantially fluid tight seal.

Figure 7:
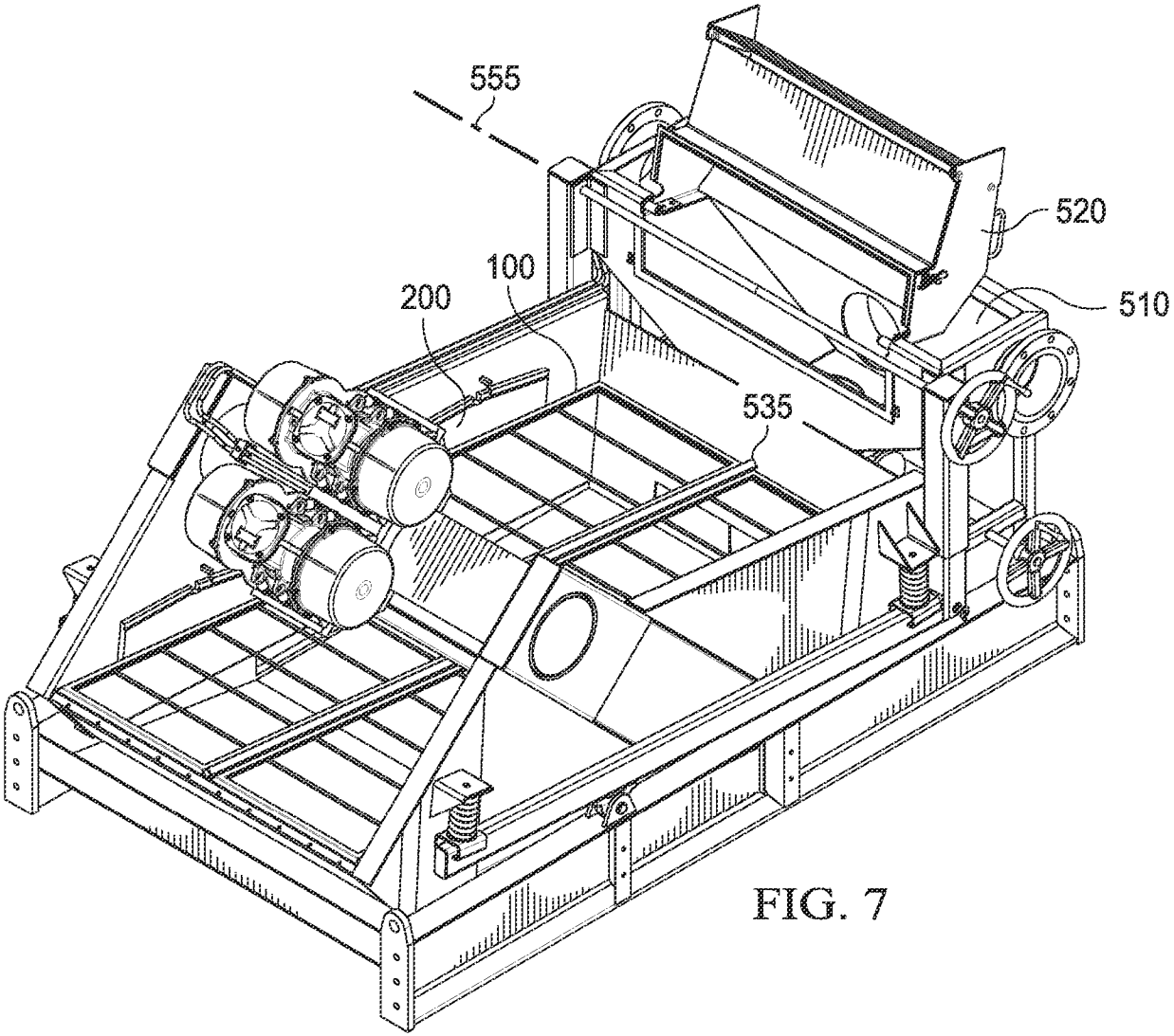
FIG. 7 is a perspective view of an embodiment of a shaker made in accordance with the principles described herein.

Referring to FIG. 7, in an embodiment, the gumbo tray 520 may be rotated up along central axis 555 and into the cavity of the possum belly 510 to allow for easier access to the upper screens 100 for installation or removal.

What is claimed is:

1. A shaker screen, comprising:

a frame having a plurality of opposing sides;

a plurality of wedge blocks, each wedge block including an angled side configured to engage a corresponding side; and a screen assembly attached to said frame;

wherein each side comprises a tubular member having an inner corner formed by a first pair of intersecting planar surfaces, an outer corner formed by a second pair of intersecting planar surfaces, and defining a longitudinal central axis;

wherein a plane intersects the longitudinal central axis, the outer corner, and the inner corner of all the opposing sides;

wherein a cross section of each tubular member is symmetrical about the plane.

2. The shaker screen of claim 1, wherein the frame is surrounded on all outer corners with a seal comprised of an elastomeric or flexible gasket.

3. The shaker screen of claim 1, wherein a first portion of each tubular member is disposed above the plane, a second portion of each tubular member is disposed below the plane, and the first portion of each tubular member is identical to and oppositely disposed from the second portion of each tubular member.

4. The shaker screen of claim 1, wherein the plane bisects each tubular member.

5. A shaker screen, comprising:

a frame having a plurality of opposing sides;

a plurality of wedge blocks, each wedge block including an angled side configured to engage a corresponding side; and a screen assembly attached to said frame;

wherein each side comprises a tubular member having an inner corner and an outer corner;

wherein a first portion of a cross section of each tubular member has upper and lower planar surfaces that are tapered about a plane and intersect at the outer corner, and a second portion of the cross section of each tubular member has upper and lower planar surfaces that are tapered about the plane and intersect at the inner corner;

wherein the plane intersects the outer corner and the inner corner of all the opposing sides.

6. The shaker screen of claim 5, wherein the frame is surrounded on all outer corners with a seal comprised of an elastomeric or flexible gasket.

7. The shaker screen of claim 5 wherein the first and second portions of the cross section are equivalently tapered about the plane.

8. The shaker screen of claim 5, wherein the plane bisects each tubular member.

9. The shaker screen of claim 5, wherein each tubular member further comprises a first pair of flanking surfaces tapered downward toward the plane and a second pair of flanking surfaces tapered upward toward the plane such that the first pair of flanking surfaces intersect the second pair of flanking surfaces at the plane.

10. A shaker screen, comprising:

a frame having a plurality of opposing sides;

a plurality of wedge blocks, each wedge block including an angled side configured to engage a corresponding side; and a screen assembly attached to said frame;

wherein each side comprises a tubular member having four planar surfaces that define an inner corner and an outer corner;

wherein a plane intersects all planar surfaces;

wherein an angle between the plane and all planar surfaces is acute.

11. The shaker screen of claim 10, wherein a first portion of each tubular member is disposed above the plane, a second portion of each tubular member is disposed below the plane, and the first portion of each tubular member is identical to and oppositely disposed from the second portion of each tubular member.

12. The shaker screen of claim 10, wherein the plane bisects each tubular member.

13. The shaker screen of claim 10, wherein a first portion of a cross section of each tubular member is tapered toward the outer corner about the plane and a second portion of the cross section of each tubular member is tapered toward the inner corner about the plane.

14. The shaker screen of claim 13 wherein the first and second portions of the cross section are equivalently tapered about the plane.

* * * * *